United States Patent [19]

Jabour

[11] 4,099,270

[45] Jul. 11, 1978

[54] SLIP-ON RUBBER GLOVES

[76] Inventor: Richard J. Jabour, 102 Butman Rd., Lowell, Mass. 01852

[21] Appl. No.: 769,119

[22] Filed: Feb. 16, 1977

[51] Int. Cl.[2] ..... A41D 19/00

[52] U.S. Cl. ..... 2/168

[58] Field of Search ..... 2/159, 161 R, 162, 170, 2/167, 168; 223/111, 112

[56] References Cited

U.S. PATENT DOCUMENTS

| | | | |
|---|---|---|---|
| 1,517,807 | 12/1924 | Steil | 2/162 |
| 1,992,344 | 2/1935 | Alhadate | 223/111 |
| 2,655,663 | 10/1953 | Hoagland | 2/170 X |
| 3,323,846 | 6/1967 | Boddy | 223/111 X |

*Primary Examiner*—Doris L. Troutman
*Attorney, Agent, or Firm*—Pearson & Pearson

[57] ABSTRACT

A pair of rubber gloves of the conventional thin, limp, rubber material used by surgeons, house-wives, etc. and each having an elongated hand portion and an elongated, integral cuff portion are each sleeved within the flexible, limp resilient cuff portion with a hollow, normally open circular-ended, substantially cylindrical, support of self-supporting sheet material such as cardboard or plastic. The hand portion is compressed within the inner portion of the support for storage and shipment and the support may be truncated conical for nesting or may be compressed to oval-ended configuration for packaging. The support may have an enlarged integral bead at each end.

5 Claims, 6 Drawing Figures

FIG. 1.
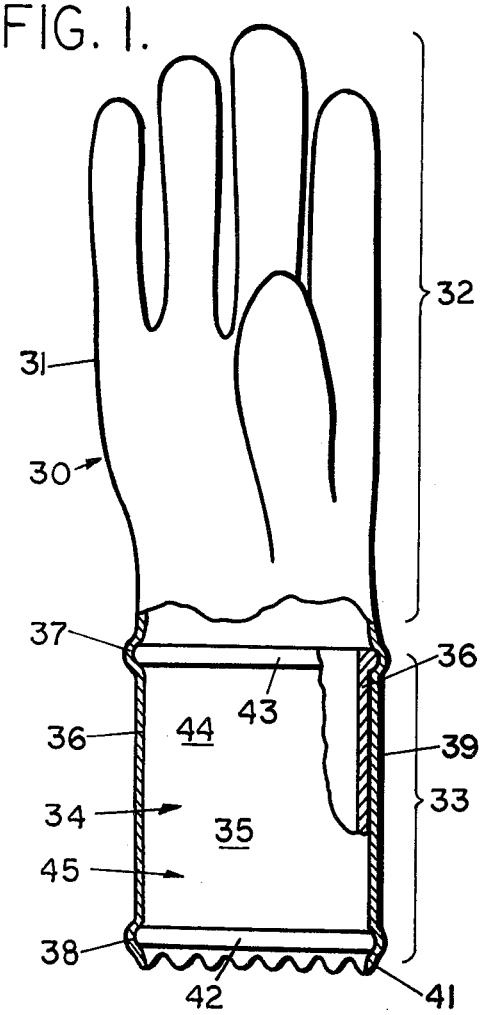
FIG. 2.
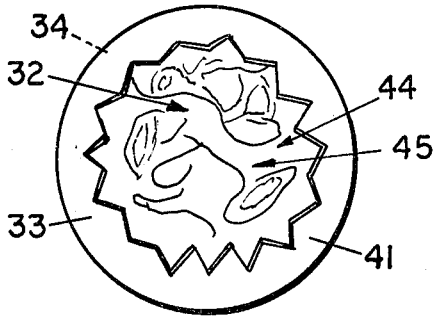
FIG. 3.
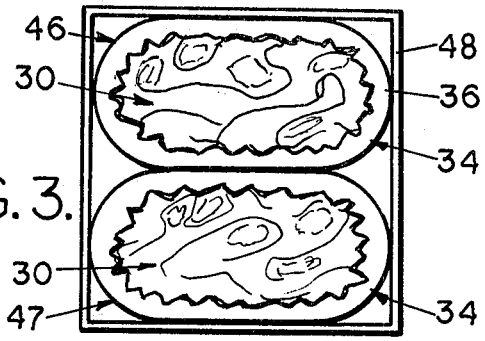
FIG. 4.
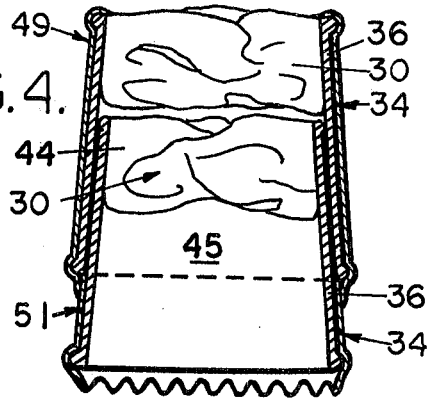
FIG. 5.
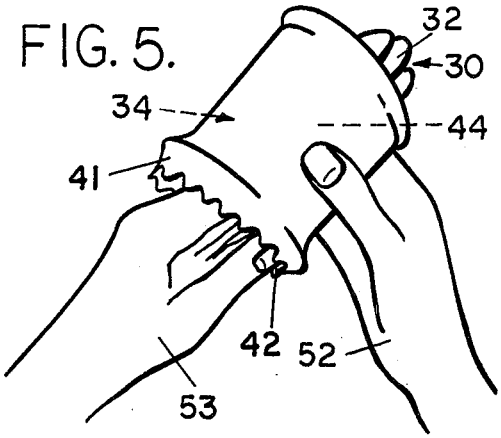
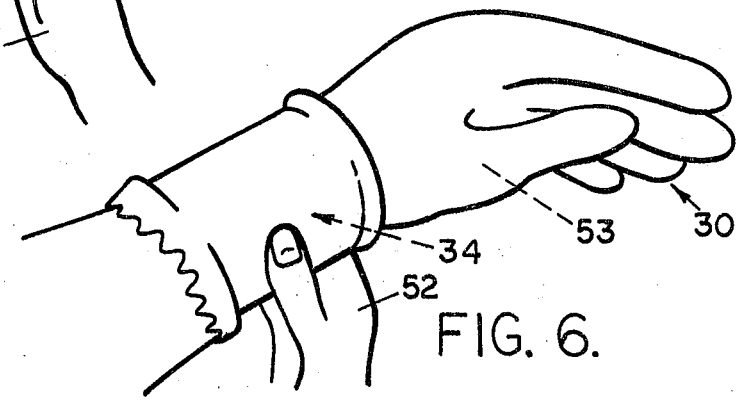
FIG. 6.

SLIP-ON RUBBER GLOVES

BACKGROUND OF THE INVENTION

It has heretofore been proposed to provide rubber gloves for use by workmen, electricians, etc. in the form of heavy gauntlets of thick, self-supporting rubber and with integral, ribbed and grooved cuff portions as in U.S. Pat. No. 2,722,687 to Nelson of Nov. 8, 1955 and U.S. Pat. No. 2,821,718 to Hall et al of Feb. 4, 1958. Such heavy thick cuffs are for protection of the wearer, whether worn extended as in the said Nelson Patent or as a turn-back reinforcement on the exterior of the glove as in the Hall Patent.

In U.S. Pat. No. 2,641,767 of June 16, 1953 to LaRosa a rubber glove is provided on the exterior of the cuff portion with a ring of sponge rubber absorbent material, the glove being intended for overhead work, with liquids.

While the drawings of the above LaRosa Patent, and of the rubber surgical glove shown in U.S. Pat. No. 3,728,739 of Apr. 24, 1973 to Semp, show rubber gloves with slight openings at the cuff, there is no teaching in any of the above mentioned patents of means sleeved within the cuff portion of a limp rubber glove for maintaining a full cylindrical configuration with normally circular end openings in the cuff for ready insertion of the hand. In fact the Semp Patent illustrates in the drawing the difficulty encountered by a user in inserting the hand in a limp rubber glove, two additional hands apparently being required for the task.

SUMMARY OF THE INVENTION

In this invention, each glove of flexible, resilient, thin, limp rubber is provided with a hollow, substantially cylindrical, normally circular ended support of self-supporting, thin sheet material such as cardboard or plastic sleeved within the cuff portion of the glove and held in place by the friction and tension of the stretched rubber overlying the support.

For shipment and storage the hand portion of each glove is stuffed, or compressed, within the inner portion of the cylindrical support and the supports of a pair of gloves may be truncated conical to nest one within the other or they may be deformed to oval configuration to occupy less space within a package.

Preferably each sleeve support is provided with an enlarged bead, of arcuate cross-section at each opposite end thereof to avoid sharp edges which might damage the thin rubber of the cuff portion stretched thereover.

A slight, limp, skirt portion of each glove may extend beyond the limits of the support and which is in unstretched condition for a reduced diameter to further assure that the support will not be dislodged rearwardly during insertion of the hand therein.

BRIEF DESCRIPTION OF THE DRAWING

FIG. 1 is a front elevation of a limp rubber glove, partly broken away and in section to show the sleeved insert of the invention.

FIG. 2 is an end view of the glove of FIG. 1 showing the hand portion of the glove stuffed into the cuff portion and showing the full open, circular ended cylindrical cuff portion.

FIG. 3 is an end elevation showing a pair of gloves of the invention compressed to oval configuration under the pressure of packaging.

FIG. 4 is a view similar to FIG. 2 showing a pair of gloves of the invention nested.

FIG. 5 is a perspective view on a reduced scale showing a glove of the invention about to be used; and FIG. 6 is a view similar to FIG. 5 showing the glove of the invention extended and worn by the user.

DESCRIPTION OF A PREFERRED EMBODIMENT

As shown in the drawing the conventional rubber glove 30 used by surgeons during operations and by housewives washing dishes is formed of thin rubber 31 which is resilient, stretchable, flexible, limp and non self-supporting. Each glove 30, of a pair of gloves, includes an elongated, fingered, hand portion 32 which may be about 8 inches long and an integral elongated cuff portion 33 about half as long, or about 4 inches in length. By cuff, I mean that part of a long glove covering the wrist or forearm.

In unstretched condition the cuff portion 33 has a normal predetermined length and a normal inside diameter, but both the length and diameter can be extended slightly by stretching the resilient material of the glove.

In this invention a hollow, substantially cylindrical, support 34 is provided, formed of thin, flexible, self-supporting material 35 which may be thin cardboard or plastic. The support 34 is of predetermined length, such as 4 inches, substantially coextensive with the cuff portion 33 and is of predetermined outside diameter slightly greater than the inside diameter of the cuff portion 33 so that the cuff portion is slightly stretched and under tension when the support 34 is sleeved, therewithin to increase friction and prevent inadvertent dislodgment.

The substantially cylindrical wall 36 of support 34 preferably includes an integral, enlarged bead 37 and 38 at each opposite end thereof and of rounded, arcuate cross-section so as to be of enlarged diameter relative to the diameter of the wall 36.

The support 34 could be firmly adhered by suitable adhesive, stapling or the like to the cuff portion 33 and therefore integral therewith but it is preferred that it be freely separable from, insertable in, and slidably removable from the glove except for the friction contact of the enlarged beads, 37 and 38, and the compressive friction exerted by the stretchable, resilient material of the glove on the exterior surface 39 of wall 36.

The wall 36 between the beads 37 and 38 is of uniform cross-section, free of ribs and grooves and the support 34 is preferably inserted within the cuff portion 33 sufficiently to leave the short, limp skirt portion 41 at the outer end of the glove. The portion 41 is unstretched and unsupported and therefore serves as a stop of reduced diameter less than that of the support to assist in preventing unwanted withdrawal of the support.

As shown in FIG. 1 the self-supporting, normally substantially cylindrical support 34 has open ends 42 and 43. As shown in FIG. 2 the support 34 normally supports the cuff portion 33 in full open cylindrical configuration with the hand portion 32 compressed and stuffed in the inner portion 44 of the interior 45 of the support.

For storage and shipment the normally full open hollow cylindrical support 34 serves as an enclosure to protect the hand portion 32 therewithin but a pair of the gloves of the invention may be compressed to oval configuration as at 46 and 47 in FIG. 3 while enclosed in a carton, or other container 48.

As shown in FIG. 4 the supports 34 may be slightly tapered to truncated conical configuration as at 49 and 51. The hand portion 32 of each glove is compressed into the inner portions 44 of each support as indicated.

In FIG. 5 a glove 30 is shown with the hand portion 32 collapsed into one end 44 of a support 34, as it is stored. Only one hand 52 of the user is necessary to hold the glove while the other hand 53 is inserted in the fully open, circular end 42 of the cuff portion 33 to urge the hand portion 32 outwardly while being readily inserted into the glove.

As shown in FIG. 6, the hand 53 of the wearer is fully inserted in the glove 30 with the self-supporting support 34 sleeved within the cuff portion so that withdrawal of the hand is equally easy and without the difficulty usually encountered in removing rubber gloves.

The support 34, being of self-supporting material, maintains its integrity and shape during storage and when in use by a surgeon so that air may circulate within the glove and thereby provide ventilation and avoiding undue perspiration of the hands and wrists of the surgeon.

Because the support 34 is sleeved within the cuff portion of the glove, it can be moved forwardly to create a skirt portion 41 of one or more inches in length and an elastic band adhered to, or seamed within, the skirt portion to seal the rear opening of the glove against contamination during use.

I claim:

1. In combination an elongated, flexible, resilient limp rubber glove having a fingered hand portion of predetermined length and an integral cuff portion of about half said length;

a hollow, elongated support of thin, self-supporting, flexible sheet material sleeved within the said cuff portion of said glove and substantially coextensive in length with said cuff portion;

said support having opposite fully open, normally circular ends and normally supporting said cuff portion in full open configuration for the easy reception of the hand of the wearer in donning the glove;

and said support having an integral, outwardly projecting bead of enlarged diameter at each opposite end thereof, each bead extending circumferentially around said support to increase the friction and tension of the cuff portion of said glove sleeved therearound and to avoid sharp peripheral edges on said support.

2. In combination:

an elongated, flexible, resilient limp, rubber glove having a fingered hand portion of predetermined length and an integral cuff portion of about half said length;

a hollow, elongated support of thin, self supporting, flexible sheet material, sleeved within the said cuff portion of said glove and substantially coextensive in length with said cuff portion;

said support having opposite, fully open, normally circular ends and normally supporting said cuff portion in full open configuration for the easy reception of the hand of the wearer in donning the glove;

and said support being formed of plastic with an integral, rounded, bead of enlarged diameter extending around each opposite end thereof.

3. In a rubber glove of the type having a hand portion and an elongated wrist cuff portion, the combination of:

an elongated, hollow, support, removably sleeved within said cuff portion and formed of thin, self-supporting sheet material, said support having fully open, normally circular ends and normally retaining said cuff portion in full open cylindrical condition for the reception of the hand of a wearer but being compressible under external pressure to substantially oval ended condition for storage and shipment;

said support having an integral, enlarged bead at at least one end thereof for increasing the frictional contact of said support with the interior of said cuff portion.

4. In combination:

an elongated, flexible, resilient, limp, rubber glove having a fingered hand portion of predetermined length and an integral cuff portion of about half said predetermined length;

and a hollow, elongated support of thin, self supporting, flexible sheet material, sleeved within the cuff portion of said glove and coextensive in length with said cuff portion, the wall of said support being of uniform cross section;

said support having opposite, fully open, normally circular ends and normally supporting the entire said cuff portion in full open, slightly stretched configuration for the easy reception of the hand of the wearer in donning the glove;

said support housing the inverted fingered hand portion of said glove, during storage and shipment, while exposing the interior walls of said hand portion to the ambient atmosphere; and said glove being free of annular sleeves, bands or rigid rings on the exterior surface of the cuff portion thereof and compressible from the outside of said cuff portion.

5. A combination as specified in claim 4 plus:

an integral extension of said cuff portion extending rearwardly beyond said support in unstretched condition to define a limp skirt of reduced diameter for retaining said support within said glove.

* * * * *